US009532145B2

(12) United States Patent
Niedermann

(10) Patent No.: US 9,532,145 B2
(45) Date of Patent: Dec. 27, 2016

(54) LOW-PROFILE SPEAKER

(75) Inventor: Paul Niedermann, Rockford, IL (US)

(73) Assignee: EAGLE ACOUSTICS MANUFACTURING, LLC, Highland Park, IL (US)

( * ) Notice: Subject to any disclaimer, the term of this patent is extended or adjusted under 35 U.S.C. 154(b) by 0 days.

(21) Appl. No.: 13/876,827

(22) PCT Filed: Dec. 23, 2011

(86) PCT No.: PCT/US2011/067228

§ 371 (c)(1),
(2), (4) Date: Mar. 28, 2013

(87) PCT Pub. No.: WO2012/088518

PCT Pub. Date: Jun. 28, 2012

(65) Prior Publication Data

US 2013/0266173 A1 Oct. 10, 2013

Related U.S. Application Data

(60) Provisional application No. 61/426,973, filed on Dec. 23, 2010.

(51) Int. Cl.

| | |
|---|---|
| ***H04R 11/02*** | (2006.01) |
| ***H04R 9/02*** | (2006.01) |
| ***H04R 9/04*** | (2006.01) |
| ***H04R 9/06*** | (2006.01) |
| *H04R 1/10* | (2006.01) |
| *H04R 27/00* | (2006.01) |

(52) U.S. Cl.

CPC ..... *H04R 9/02* (2013.01); *H04R 9/041* (2013.01); *H04R 9/063* (2013.01); *H04R 1/10* (2013.01); *H04R 9/025* (2013.01); *H04R 27/00* (2013.01); *H04R 2499/13* (2013.01)

(58) Field of Classification Search

USPC ..... 381/419, 421, 401

See application file for complete search history.

(56) References Cited

U.S. PATENT DOCUMENTS

| | | | |
|---|---|---|---|
| 1,844,802 | A | 2/1932 | Seabert |
| 3,979,566 | A | 9/1976 | Willy |
| 5,682,436 | A | 10/1997 | Sakamoto et al. |

(Continued)

FOREIGN PATENT DOCUMENTS

| | | |
|---|---|---|
| CN | 2850185 | 12/2006 |
| CN | 2935688 | 8/2007 |

(Continued)

*Primary Examiner* — Davetta W Goins
*Assistant Examiner* — Amir Etesam
(74) *Attorney, Agent, or Firm* — Clark Hill PLC; James R. Foley

(57) ABSTRACT

A low-profile speaker that includes a low-profile frame, and a first magnet assembly disposed in the low-profile frame. The first magnet assembly has a first cage and a plurality of magnets disposed in the first cage. The low-profile speaker also includes a support assembly having a cone and a support ring attached to the cone, and a voice coil attached to the support ring. The support ring and voice coil are suspended in relatively close proximity to the magnet assembly such that the support ring and voice coil oscillate in response to electrical signals in the voice coil.

18 Claims, 12 Drawing Sheets

(56) References Cited

U.S. PATENT DOCUMENTS

| | | | | |
|---|---|---|---|---|
| 5,828,767 | A * | 10/1998 | Button | H04R 3/002 381/400 |
| 6,047,077 | A | 4/2000 | Larsen | |
| 6,130,954 | A | 10/2000 | Carver | |
| 6,151,401 | A | 11/2000 | Annaratone | |
| 6,208,237 | B1 | 3/2001 | Saiki et al. | |
| 6,611,606 | B2 * | 8/2003 | Guenther | H04R 9/02 381/412 |
| 6,675,931 | B2 | 1/2004 | Sahyoun | |
| 6,760,456 | B1 | 7/2004 | Annaratone | |
| 6,863,152 | B1 | 3/2005 | Sahyoun | |
| 6,895,099 | B2 | 5/2005 | Lee et al. | |
| 7,184,567 | B2 | 2/2007 | Sugata et al. | |
| 7,218,748 | B1 | 5/2007 | Stompler | |
| 7,302,076 | B2 | 11/2007 | Guenther | |
| 7,317,810 | B2 | 1/2008 | Ohashi | |
| 7,400,917 | B2 | 7/2008 | Wood et al. | |
| 7,426,283 | B2 * | 9/2008 | Kaiya | H04R 9/022 381/397 |
| 7,519,191 | B2 | 4/2009 | Enomoto et al. | |
| 8,112,060 | B2 | 2/2012 | Sip | |
| 8,139,813 | B2 | 3/2012 | Kobayashi et al. | |
| 8,144,916 | B2 | 3/2012 | Zhang | |
| 8,170,268 | B2 | 5/2012 | Weyreuther | |
| 8,180,096 | B2 | 5/2012 | Sano et al. | |
| 8,204,269 | B2 | 6/2012 | Sahyoun | |
| 8,256,568 | B2 | 9/2012 | Lin | |
| 8,265,329 | B2 | 9/2012 | Lin | |
| 8,290,199 | B2 | 10/2012 | Pircaro | |
| D670,911 | S | 11/2012 | Bollinger et al. | |
| 8,331,599 | B2 | 12/2012 | Yun | |
| 8,335,131 | B2 | 12/2012 | Rorick | |
| 8,391,515 | B2 | 3/2013 | Lu | |
| 8,447,063 | B2 | 5/2013 | Chu | |
| 8,494,207 | B2 | 7/2013 | Lin | |
| 8,520,886 | B2 | 8/2013 | Wilk | |
| 8,638,976 | B2 | 1/2014 | Watanabe | |
| 8,698,360 | B2 * | 4/2014 | Kjeldsteen | H02K 1/28 310/156.38 |
| 2004/0086150 | A1 * | 5/2004 | Stiles | 381/421 |
| 2004/0159490 | A1 * | 8/2004 | Marlin | H04R 9/02 181/148 |
| 2004/0161129 | A1 | 8/2004 | Guenther | |
| 2004/0213431 | A1 | 10/2004 | Mello | |
| 2005/0041831 | A1 | 2/2005 | Stiles et al. | |
| 2005/0190946 | A1 * | 9/2005 | Stiles | H04R 9/025 381/421 |
| 2005/0232456 | A1 | 10/2005 | Guenther | |
| 2005/0271226 | A1 | 12/2005 | Tanabu et al. | |
| 2006/0058070 | A1 | 3/2006 | Chang | |
| 2007/0242850 | A1 * | 10/2007 | Sumitani | H04R 7/18 381/413 |
| 2008/0080736 | A1 | 4/2008 | Sumitani et al. | |
| 2008/0132289 | A1 | 6/2008 | Wood et al. | |
| 2008/0253590 | A1 | 10/2008 | Sun | |
| 2009/0312058 | A9 | 12/2009 | Wood et al. | |
| 2010/0119095 | A1 | 5/2010 | Grenzing | |
| 2010/0177925 | A1 | 7/2010 | Furuto | |
| 2010/0303278 | A1 * | 12/2010 | Sahyoun | H04R 9/043 381/398 |
| 2011/0200204 | A1 | 8/2011 | Horigome | |
| 2012/0172090 | A1 | 7/2012 | Capps | |
| 2012/0213398 | A1 | 8/2012 | Itoh | |
| 2012/0308070 | A1 | 12/2012 | Lee | |
| 2013/0051597 | A1 | 2/2013 | Yeom | |
| 2013/0064413 | A1 | 3/2013 | Cazes | |
| 2013/0077235 | A1 | 3/2013 | Pawar | |
| 2013/0083953 | A1 | 4/2013 | Chang | |
| 2013/0089231 | A1 | 4/2013 | Wilk | |
| 2013/0101150 | A1 | 4/2013 | Yun | |
| 2013/0133975 | A1 | 5/2013 | Kim et al. | |
| 2013/0177181 | A1 | 7/2013 | Marcus | |
| 2013/0279735 | A1 | 10/2013 | Chu et al. | |
| 2013/0308799 | A1 | 11/2013 | Lin et al. | |
| 2013/0319897 | A1 | 12/2013 | Hsu | |
| 2013/0329937 | A1 | 12/2013 | He | |
| 2013/0336517 | A1 | 12/2013 | Wilk | |
| 2014/0119579 | A1 | 5/2014 | Servado | |

FOREIGN PATENT DOCUMENTS

| | | |
|---|---|---|
| DE | 102007030811 | 11/2008 |
| DE | 202013101179 | 3/2013 |
| DE | 202013101182 | 4/2013 |
| EP | 1414267 | 4/2004 |
| EP | 1482762 | 12/2004 |
| EP | 1553802 | 7/2005 |
| EP | 1633167 | 3/2006 |
| EP | 0845920 | 6/2006 |
| EP | 1883268 | 1/2008 |
| EP | 2124480 | 11/2009 |
| EP | 1480491 | 5/2011 |
| EP | 2453668 | 5/2012 |
| EP | 1942701 | 8/2012 |
| EP | 2490461 | 8/2012 |
| EP | 2566192 | 3/2013 |
| EP | 2071868 | 6/2013 |
| FR | 2866777 | 8/2005 |
| GB | 2500718 | 10/2013 |
| JP | 01-126900 | 5/1989 |
| JP | 1-133897 | 9/1989 |
| JP | 08-223690 | 8/1996 |
| JP | 09-200894 | 7/1997 |
| JP | 2008-211733 | 2/2007 |
| JP | 2007104634 | 4/2007 |
| JP | 2007-336322 | 12/2007 |
| JP | 2008011043 | 1/2008 |
| WO | 2007135746 | 11/2007 |
| WO | 2008038759 | 4/2008 |
| WO | 2008/072332 | 6/2008 |
| WO | 2009/063557 | 5/2009 |
| WO | 2009/066415 | 5/2009 |
| WO | 2010047157 | 4/2010 |
| WO | 2010135106 | 11/2010 |
| WO | 2011148109 | 12/2011 |
| WO | 2012064762 | 5/2012 |
| WO | 2012080912 | 6/2012 |
| WO | 2012112790 | 8/2012 |
| WO | 2012171846 | 12/2012 |
| WO | 2013144597 | 10/2013 |

* cited by examiner

LOW-PROFILE SPEAKER

CROSS-REFERENCE TO RELATED PATENT APPLICATIONS

This patent application is a continuation of co-pending PCT/US2011/067228, filed Dec. 23, 2011, designating the United States, which claims the benefit of U.S. Provisional Patent Application No. 61/426,973, filed Dec. 23, 2010, the entire teachings and disclosure of which are incorporated herein by reference thereto.

FIELD OF THE INVENTION

This invention generally relates to speakers, such as those used in a variety of consumer electronics and audio systems.

BACKGROUND OF THE INVENTION

Audio systems are typically employed in the home, in the workplace, in automobiles, and in a number of portable electronic devices. One consideration in determining how these audio systems are deployed is the amount of space required for the system. In many cases, the speakers are the largest component of the audio system. Typically, the cabinet and various speaker components, particularly those components for providing low-frequency sound with little distortion, such as woofers or subwoofers for example, tend to be large and bulky. The size of a typical subwoofer sometimes makes it difficult to easily and conveniently incorporate them into automobiles, for instance, in home audio systems, or in commercial applications where space is limited, or in systems where the user wishes to keep the components somewhat invisible to the listener. It would therefore be desirable to have speaker components that provide clear, low-frequency sound but which are less bulky than conventional speaker components.

A particular approach to subwoofer design that reduces the size of the subwoofer cabinet is disclosed in U.S. Pat. No. 6,130,954, issued to Carver, the teachings and disclosure of which is incorporated in its entirety herein by reference thereto.

Embodiments of the invention provide such a speaker component for providing clear, low-frequency sound with little distortion. These and other advantages of the invention, as well as additional inventive features, will be apparent from the description of the invention provided herein.

BRIEF SUMMARY OF THE INVENTION

In one aspect, embodiments of the invention provide a low-profile speaker having a low-profile frame, and a first magnet assembly disposed in the low-profile frame. The first magnet assembly has a first cage and a plurality of magnets disposed in the first cage. The low-profile speaker also includes a support assembly having a cone and a support ring attached to the cone, and a voice coil attached to the support ring. The support ring and voice coil are suspended in relatively close proximity to the magnet assembly such that the support ring and voice coil oscillate in response to electrical signals in the voice coil.

In a particular embodiment, the plurality of magnets are disposed in individual pockets around the circumference of the cage. The first magnet assembly, second magnet assembly, and bottom plate may be annular or rectangular. In a further embodiment, the voice coil is a metal wire wound around the support ring, and the first magnet assembly and the voice coil are concentric about a central axis of the frame. The magnet assembly is disposed along an interior perimeter surface of the frame. The voice coil may have a larger diameter than the magnet assembly in certain embodiments, and a smaller diameter than the magnet assembly in alternate embodiments.

In another aspect, embodiments of the invention provide a low-profile speaker having a low-profile frame, and a first magnet assembly disposed in the low-profile frame. The first magnet assembly has a first cage and a first solid ring of composite magnetic material disposed in the first cage. The low-profile speaker also includes a support assembly having a cone and a support ring attached to the cone, and a voice coil attached to the support ring. The support ring and voice coil are suspended in relatively close proximity to the magnet assembly such that the support ring and voice coil oscillate in response to electrical signals in the voice coil.

In embodiments of the invention, the first solid ring of composite magnetic material includes a plurality of fragments of magnetic material suspended in an epoxy. The poles of the plurality of fragments are aligned prior to the hardening of the epoxy. In a particular embodiment, the fragments of magnetic material include fragments of neodymium.

The low-profile speaker may further include a surround attached to the low-profile frame and to the support assembly. The surround is made of a resilient material and has an outer perimeter portion, and inner perimeter portion, and an arched portion that joins the inner and outer perimeter portions. The outer perimeter portion is attached to the low-profile frame, and the inner perimeter portion is attached to a cone. The cone is flat or concave with respect to the low-profile frame. In particular embodiments, the surround is made from butyl rubber.

In one particular embodiment of the low-profile speaker, the first magnet assembly has a pole piece attached to a bottom surface of the first solid ring of composite magnetic material. The pole piece has a horizontal portion and a vertical portion. A top plate is attached to a top surface of the first solid ring of composite magnetic material. A gap between the top plate and the vertical portion accommodates the support ring and voice coil.

Further, the low-profile speaker may include a second magnet assembly disposed in the low-profile frame. The second magnet assembly has a second cage and a second solid ring of composite magnetic material disposed in the second cage. The second magnet assembly is concentric with, and has a smaller width or diameter than, the first magnet assembly. The first magnet assembly and the second magnet assembly are connected by a bottom plate attached to bottom surfaces of the first and second solid rings of composite magnetic material in the first and second magnet assemblies. In embodiments, a first top plate is attached to a top surface of the first solid ring of composite magnetic material, and a second top plate is attached to a top surface of each of the second solid ring of composite magnetic material. A gap between the first top plate and the second top plate accommodates the support ring and voice coil.

In a particular embodiment, the first solid ring of composite magnetic material includes magnetic fragments whose individual magnetic poles are aligned such the first solid ring of composite magnetic material effectively has a single north pole and a single south pole. Further, a second voice coil is wound onto the support ring, the voice coil and the second voice coil being in close proximity to opposite poles of the first solid ring of composite magnetic material. The ratio of the width or diameter of the low-profile speaker to the depth of the speaker is greater than 10, in some embodiments, and greater than 20 in more particular embodiments.

In yet another aspect, embodiments of the invention provide a low-profile speaker that includes a frame having a stepped portion. The stepped portion has a plurality of openings and there are a plurality of magnets disposed in the plurality of openings. A voice coil is supported by a cone disc that fits within the stepped frame, and the voice coil is suspended in relatively close proximity to the plurality of magnets. Together, a top plate and pole piece hold the plurality of magnets in the frame. The top plate and pole piece are assembled such that the voice coil can oscillate in a gap between the top plate and pole piece.

A particular low-profile speaker includes a surround made from a resilient material, the surround having an outer perimeter portion and an inner perimeter portion, the outer perimeter portion being attached to the frame, and the inner perimeter portion attached to the cone disc such that the cone disc and voice coil are suspended between the gap between the top plate and pole piece.

In an embodiment, the cone disc is made from one of aluminum and a transparent material. A perimeter portion of the frame may include a plurality of openings. In a further embodiment, the pole piece has a horizontal portion and a vertical portion, and the aforementioned gap is between the vertical portion and an inner perimeter surface of the top plate.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
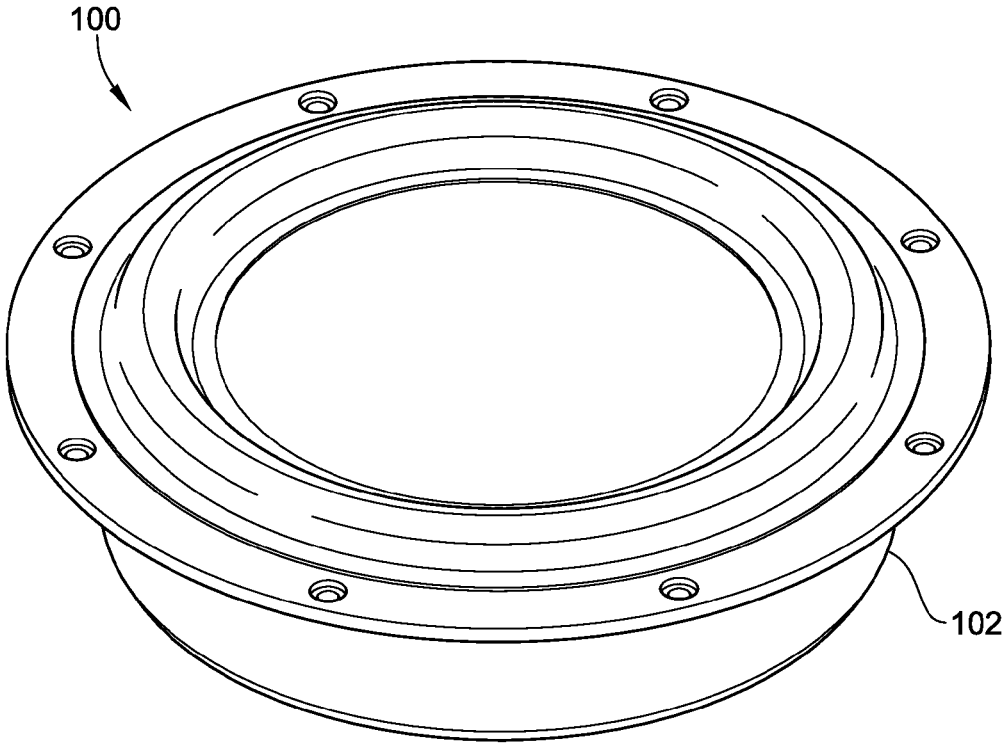
FIG. 1 is a perspective view of a low-profile speaker, constructed in accordance with an embodiment of the invention.

FIG. 1 shows a perspective view of a low-profile speaker 100 constructed in accordance with an embodiment of the invention. In a particular embodiment, the low-profile speaker 100 of FIG. 1 is a sub-woofer, configured to provide low-frequency sound. In many conventional speaker systems, the subwoofer (or simply "sub") is typically between 8" and 21" in diameter, which is dedicated to the reproduction of low-pitched audio frequencies (i.e., the "bass"). The typical frequency range for a subwoofer is about 20-200 Hz for consumer products, below 100 Hz for professional live sound, and often below 80 Hz for the most advanced subwoofers.

Figure 2:
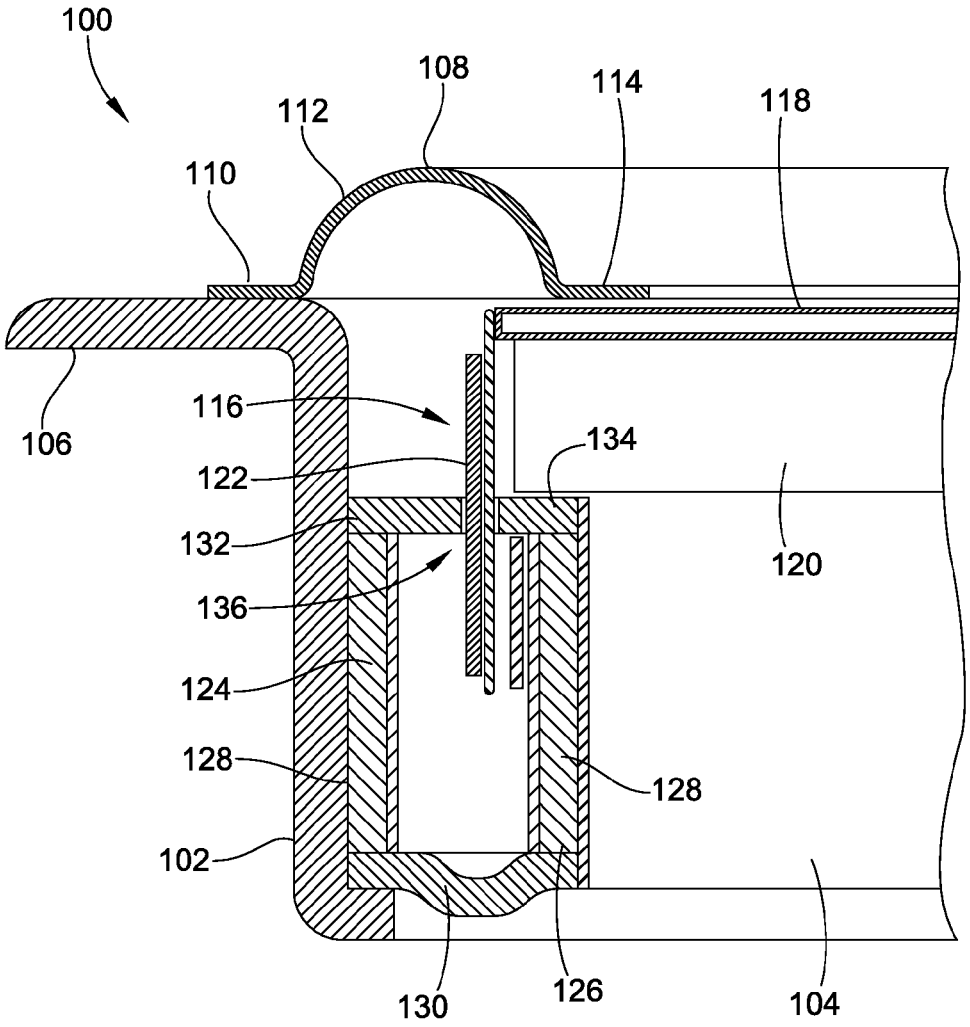
FIG. 2 is a cross-sectional view of the low-profile speaker of FIG. 1, constructed in accordance with a particular embodiment of the invention.

In the embodiment of FIG. 1, the low-profile speaker 100 includes a substantially disk-shaped, low-profile frame 102 which (as shown in FIG. 2) includes a cup-like portion 104 in the disk-shaped interior, and a flanged portion 106 at the periphery of the disk-shaped frame 102 attached to the top rim of the cup-like portion 104. In at least one embodiment, the frame 102 is shaped and formed from a single malleable, yet sufficiently rigid, material, or molded from a suitably rigid material. However, in alternate embodiments, the frame 102 is assembled from separate components.

Figure 3:
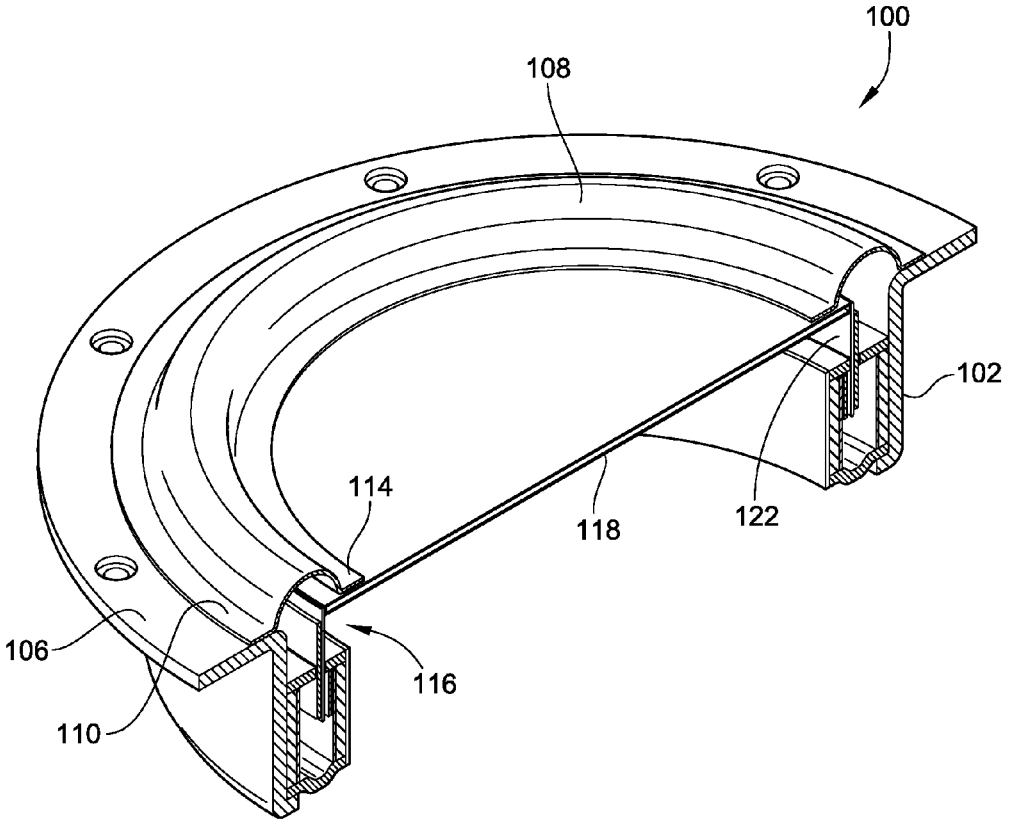
FIG. 3 is a cross-sectional view of the low-profile speaker of FIG. 2, shown from a different angle and offering a perspective view of the low-profile speaker.

As shown in FIGS. 2 and 3, on a surface of the flanged portion 106, a surround 108 is attached. The surround 108 is an annular component, made from a resilient material, for example an elastomer, such as butyl rubber. In a particular embodiment, the annular surface of the surround 108 is arched, with a first flat portion 110, or outer flat portion, of the arch 112 and a second flat portion 114, or inner flat portion, of the arch 112, such that the apex of the arch 112 forms a circle roughly at the midway point between the inner diameter and the outer diameter of the annular surround 108. The first flat portion 110 of the surround 108 is attached to the surface of the flanged portion 106 of the frame 102. The second flat portion 114 of the surround 108 extends radially into the cup-like portion 104 and, as shown in FIGS. 2 and 3, is attached to a support assembly 116 that includes a cone 118 and a support ring 120. With respect to embodiments of the invention, the "cone" is not necessarily conical, and may have various shapes including, but not limited to, flat, concave, convex, and conical. In conventional speakers, the support ring 120 is more typically referred to as a former or voice coil former.

FIGS. 2 and 3 show a cross-sectional view of the low-profile speaker 100. The second flat portion 114 of the surround 108 is attached to a flat, circular cone 118. The circular cone 118 is, in turn, attached to the support ring 120, which supports a voice coil 122. In embodiments of the invention, the voice coil 122 comprises wire made from aluminum, copper, alloys of these metals or from some other suitable material. The wire is wound around the support ring 120. The support ring 120 may be made from plastic, or some other lightweight but rigid material suitable for supporting the voice coil 122. The embodiment of FIG. 2 shows a first magnet assembly 124 and second magnet assembly 126.

In at least one embodiment, each magnet assembly 124, 126 comprises an annular cage for holding a plurality of magnets 128. Typically, the annular cage is configured to evenly space the plurality of magnets 128 around the circumference of the frame 102. The first and second magnet assemblies 124, 126 shown are annular, the first magnet assembly 124 having a greater diameter that the second magnet assembly 126. The frame 102 may be constructed to hold the annular cage in the proper position. In certain embodiments, the magnets 128 are placed side by side in pockets around the entire circumference of the annular cage.

The first magnet assembly 124, or outer magnet assembly, is located substantially along an inner wall of the cup-like portion 104 of the frame 102 in spaced relation to an outer diameter surface of the voice coil 122 and support ring 120. The second magnet assembly 126, or inner magnet assembly, is located in spaced relation to an inner diameter surface of the voice coil 122 and support ring 120. In at least one embodiment, the magnet assemblies 124, 126 each include magnets 128 made from rare earth metals such as neodymium or samarium cobalt. The strength of these magnets 128 allows for the construction of smaller, lighter magnet assemblies than typically found in conventional speakers. In a particular embodiment, each magnet 128 is rectangular and measures approximately one inch in height by one half inch in width by an eighth inch in depth. However, alternate embodiments may include magnets 128 larger or smaller than this. Further, in alternate embodiments, the magnets 128 may be curved rather than flat, or may have a shape other than rectangular.

An annular bottom plate 130 connects the bottom surfaces of the magnets 128 in the outer magnet assembly 124 to the bottom surfaces of the magnets 128 in the inner magnet assembly 126. In conventional speakers, this bottom plate 130 is sometimes referred to as a pole piece. In at least one embodiment, the annular bottom plate 130 is arched away from the magnets 128 to create more space for the voice coil 122 to move between the magnet assemblies 124, 126. There are two annular top plates. A first top plate 132, or outer top plate is attached to the top surfaces of the magnets 128 in the outer magnet assembly 124. The second top plate 134, or inner top plate, is attached to the top surfaces of the magnets 128 in the inner magnet assembly 126.

As seen in FIG. 2, the first and second magnet assemblies 124, 126, along with the bottom and top plates 130, 132, 134 form a rectangular or boxlike cross-section with an opening therein for the voice coil 122. The opening is more accurately described as an annular gap 136 between the outer first top plate 132 and the inner second top plate 134. This annular gap, typically referred to as the magnetic gap 136, is spaced just wide enough to allow the annular voice coil 122 and attached support ring 120 to move back and forth in the magnetic gap 136 without contacting either of the top plates 132, 134. Thus, when the low-profile speaker 100 is not operating, the voice coil 122 and support ring 120 are suspended, via their connection to the cone 118 and surround 108, in the magnetic gap 136 between the two annular top plates 132, 134 with at least a portion of the voice coil 122 between the two magnet assemblies 124, 126. In an embodiment, the bottom plate and two top plates are made from a ferromagnetic material.

By making the magnet assemblies 124, 126 annular and spacing the voice coil 122 in relation to the magnet assemblies 124, 126, it is possible to construct a subwoofer having a significantly reduced depth as compared to conventional subwoofers. The annular inner and outer magnet assemblies 124, 126 are substantially concentric. During operation, the inner and outer magnet assemblies 124, 126, along with the top plates 132, 134 and bottom plate 130, generate a magnetic field sufficient to drive the voice coil 122 and attached support ring 120 with little distortion of low-frequency sound, even within the shallow depth of the low-profile speaker 100. It is contemplated that a typical embodiment of the low-profile speaker 100 (e.g., for a home-based audio system), when using magnets 128 roughly one inch in height, will have a depth, or thickness, of approximately two to three inches even for diameters up to 20 inches or more. However, it is also contemplated that this depth of three inches could be further reduced, to less than two inches, or to less than one inch, for example, by reducing the height of the magnets 128 and the corresponding height of the voice coil 122. Thus, in embodiments of the low-profile speaker 100, the ratio of the diameter or width of the low-profile frame 102 to the thickness or depth of the frame 102 will range from approximately seven to 25, and, in some embodiments, may be greater than 25. In the context of this application, the term "low-profile" refers to speakers and speaker components having ratios of width to depth in the aforementioned range.

It should also be noted that the designs disclosed herein are scalable, thus allowing the low-profile speaker 100 to be miniaturized for used in applications such as headphones, cellular phones and MP3 players. However, at the other end of the spectrum, the low-profile speaker 100 can be manufactured in larger sizes more suited to use in speaker systems for the home or automobile, or in sizes suitable for use in commercial applications, such as speaker systems for use in stadiums or entertainment venues. Therefore, it is envisioned that this design will be used in speakers as small as one half inch in diameter to more than 30 inches in diameter. Further, the scalability of the low-profile design allows for all sizes of the speaker to have ratios of width to depth in accordance with the range specified above.

Figure 4:
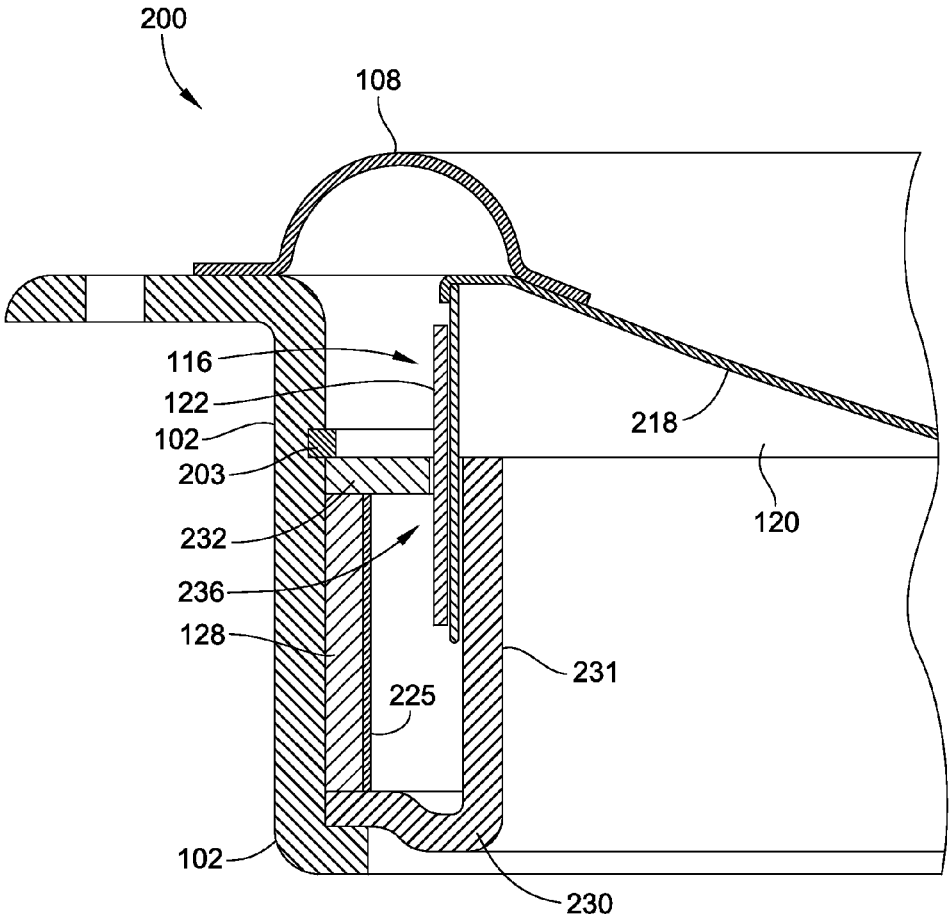
FIG. 4 is a cross-sectional view of a low-profile speaker, constructed in accordance with an alternate embodiment of the invention.
Figure 5:
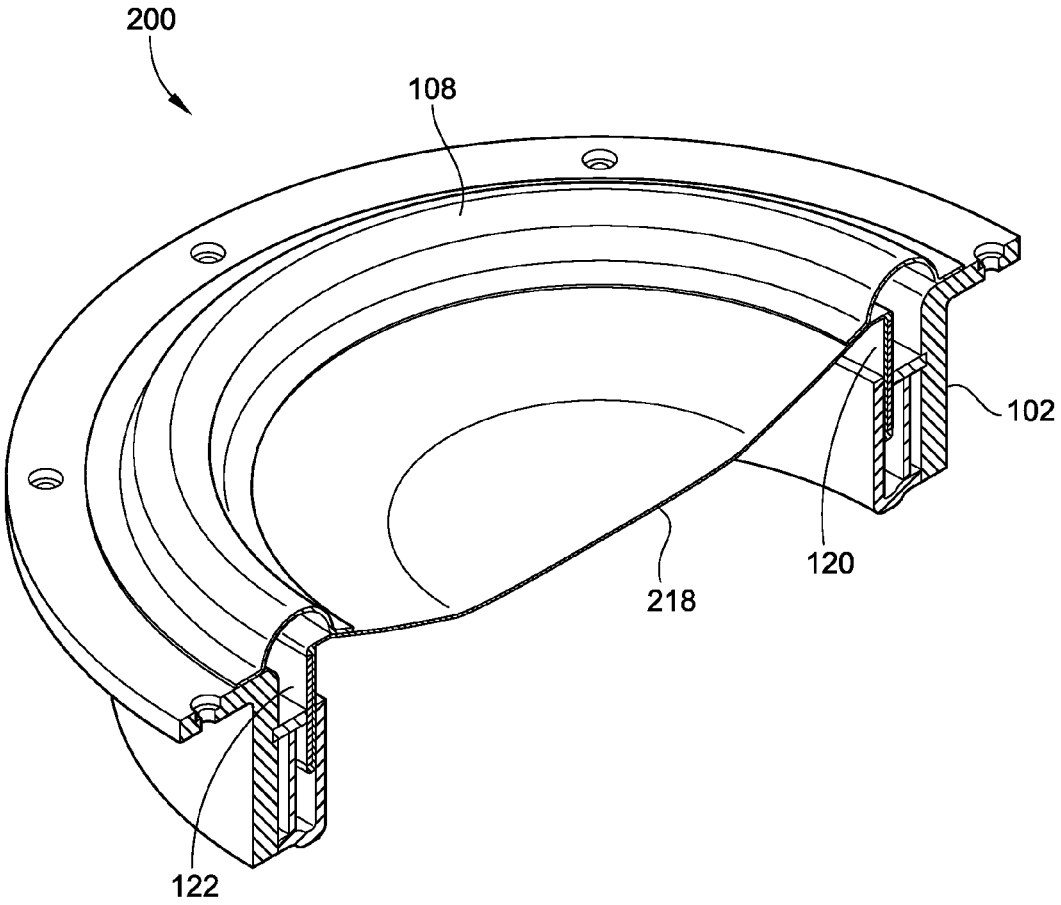
FIG. 5 is a cross-sectional view of the low-profile speaker of FIG. 4, shown from a different angle and offering a perspective view of the low-profile speaker.

In an alternate embodiment of the invention which is also illustrated by FIGS. 2 and 3, a magnet assembly is employed that includes a solid ring of composite magnetic material. In this embodiment, a number of fragments of magnetic material, for example neodymium, are suspended in a liquid epoxy. The liquid epoxy is formed into a ring and the poles of the magnetic fragments are aligned so that the ring has essentially a single north pole and a single south pole. The epoxy is then cured to form a rigid magnetic ring. The magnetic ring can be attached to the top plates 132 and bottom plate 130 of ferromagnetic material and assembled into the speaker frame 102, as shown in the embodiments of FIGS. 4 and 5, described below. In a further embodiment, two solid magnetic rings 124, 126 of slightly different diameter are used to represent the magnets 128 on each side of the voice coil 122, as shown in the embodiments of FIGS. 2 and 3. Typically, the solid magnetic rings 124, 126 are arranged concentrically, and the bottom plate 130 of ferromagnetic material is assembled to both magnetic rings 124, 126 joining the rings 124, 126 at a bottom edge as shown in FIGS. 2 and 3. In an embodiment, each magnetic ring 124, 126 has its own top plate 132, 134 of ferromagnetic material arranged such that a magnetic gap 136 is formed to allow for movement of the suspended voice coil 122 therein, as shown in FIGS. 2 and 3.

FIGS. 4 and 5 show a cross-sectional view of an alternate embodiment of the low-profile speaker 200. In this alternate embodiment, the frame 102, surround 108, voice coil 122, and support ring 122 are the similar or identical to the components in the embodiment of FIGS. 2 and 3. However, the alternate embodiment has only one magnetic assembly 224 having a cage 225 and a plurality of rectangular magnets 128. Further, the cone 218 in this embodiment is concave, curved into the cup-like portion 104 of frame 102, instead of being flat like cone 118 of FIGS. 1-3. In the embodiment of FIGS. 4 and 5, the magnetic assembly 224 is located along the inner wall of the cup-like portion 104 of the frame 102 facing the outer diameter surface of the voice coil 122 and support ring 120. In some embodiments, a snap ring 203, or similar device, is used to secure the magnet assembly 224 in place in the frame 102. A top plate 232 is attached to a top surface of the magnets 128 in the magnet assembly 224, and extends horizontally for a short distance from the tops of the magnets 128. A bottom plate or pole piece 230 is attached to the bottom surfaces of the magnets 128 in the magnet assembly 224. The pole piece 230 extends horizontally from the magnet 128 under the annular voice coil 122, and a vertical portion 231 extends up in spaced relation to the inner diameter surface of the voice coil 122 and support ring 120.

In this arrangement, there is a magnetic gap 236 between the top plate 232 and the vertical portion 231 of the pole piece 230. In at least one embodiment, top plate 232 and the pole piece 230 are made from a ferromagnetic material. In this way, the voice coil 122 and support ring 120 are suspended in the magnetic gap 236 between the top plate 232 and vertical portion 231 of the pole piece 230, and also between the magnet assembly 224 and the vertical portion 231 of the pole piece 230.

During operation, the magnet assembly 224 and pole piece 230 generate a magnetic field sufficient to drive the voice coil 122 and attached support ring 120, even within the shallow depth of the low-profile speaker 200, with little distortion of low-frequency sound. Supported in suspension by the attachment to the surround 108, the support assembly 116 oscillates, or moves back and forth in the space between the magnet assembly 224 and vertical portion 231 of the pole piece 230. In particular embodiments of the invention, the range of movement for the voice coil 122 is from approximately one half inch to three quarters of an inch. However, depending on the size of the magnets 128 and on the thickness of the voice coil 122, the range of movement for the voice coil 122 may be greater or lesser than one half to three quarters of an inch.

In an alternate embodiment of the invention of FIGS. 4 and 5, the magnetic assembly 224 is positioned inside of the voice coil 122 and support ring 120 such that the magnets 128 face the inner diameter face of the voice coil 122 and support ring 120. In this embodiment, the pole piece 230 is attached to the bottom surfaces of the magnets 128 as in the above-described embodiment. The vertical portion 231 extends under the annular voice coil 122 and up in spaced relation to the outer diameter surface of the voice coil 122 and support ring 120. As in the example above, the pole piece 230 is made from a ferromagnetic material. Also, as in the above example, the voice coil 122 and support ring 120 are suspended between the magnet assembly 224 and the vertical portion 231 of the pole piece 230. Further, the voice coil 122 in this further embodiment oscillates, or moves back and forth in the magnetic gap 236 between the magnet assembly 224 and vertical portion 231 of the pole piece 230.

Figure 6:
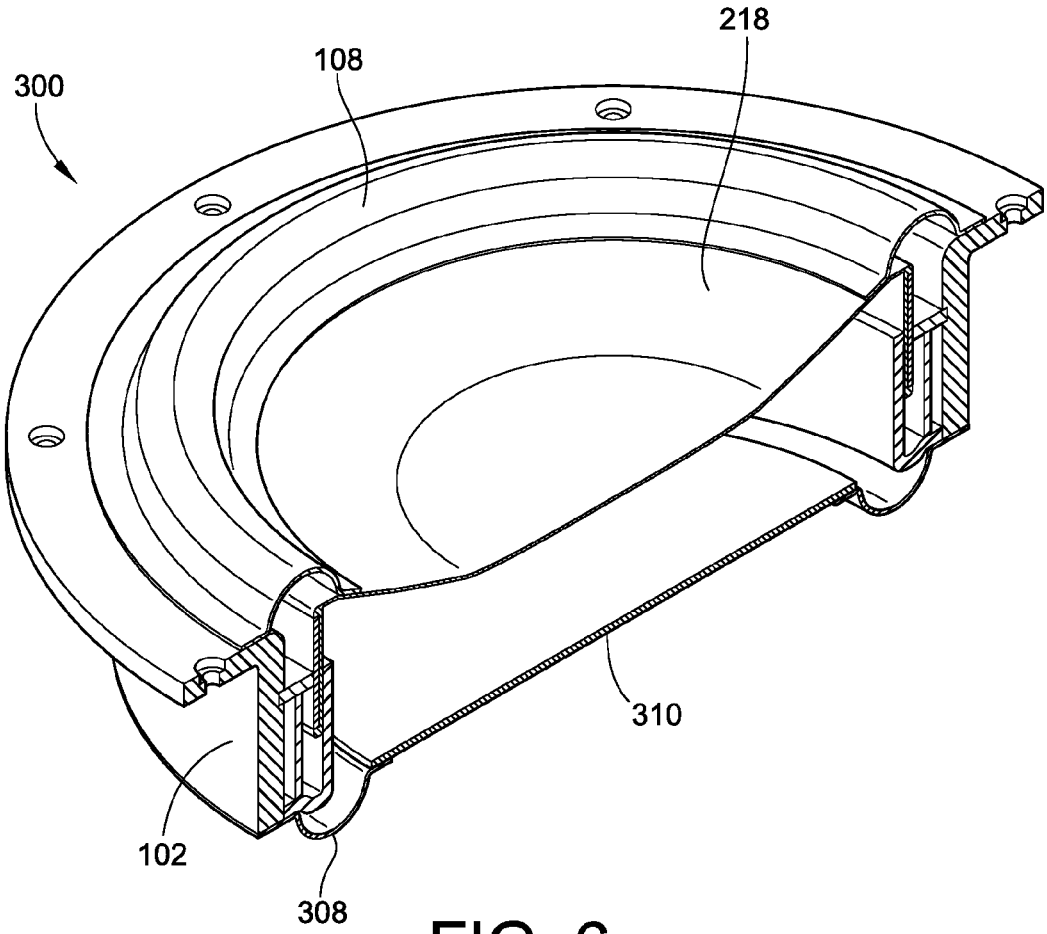
FIG. 6 is a cross-sectional view of the low-profile speaker including a rear baffle and second surround, in accordance with an embodiment of the invention.

FIG. 6 illustrates an embodiment of the low-profile speaker 300, which includes the surround 108, concave cone 218, and a rear baffle 308 attached to the frame 102. Rear baffle 308 is structurally similar to the surround 108, being made of a resilient elastomeric material such as butyl rubber. The rear baffle 108 allows for some movement of a rear portion 310 of the frame 102. In this configuration, the low-profile speaker 300 performs similarly to an isobaric speaker, in that the frequency response is lowered. Typically, the term "isobaric speaker" refers to the operational characteristics of the use of at least two woofers, or bass drivers, in a loudspeaker unit. The use of isobaric loading in a speaker system in practical terms is to lower the bass frequency response.

Figure 7:
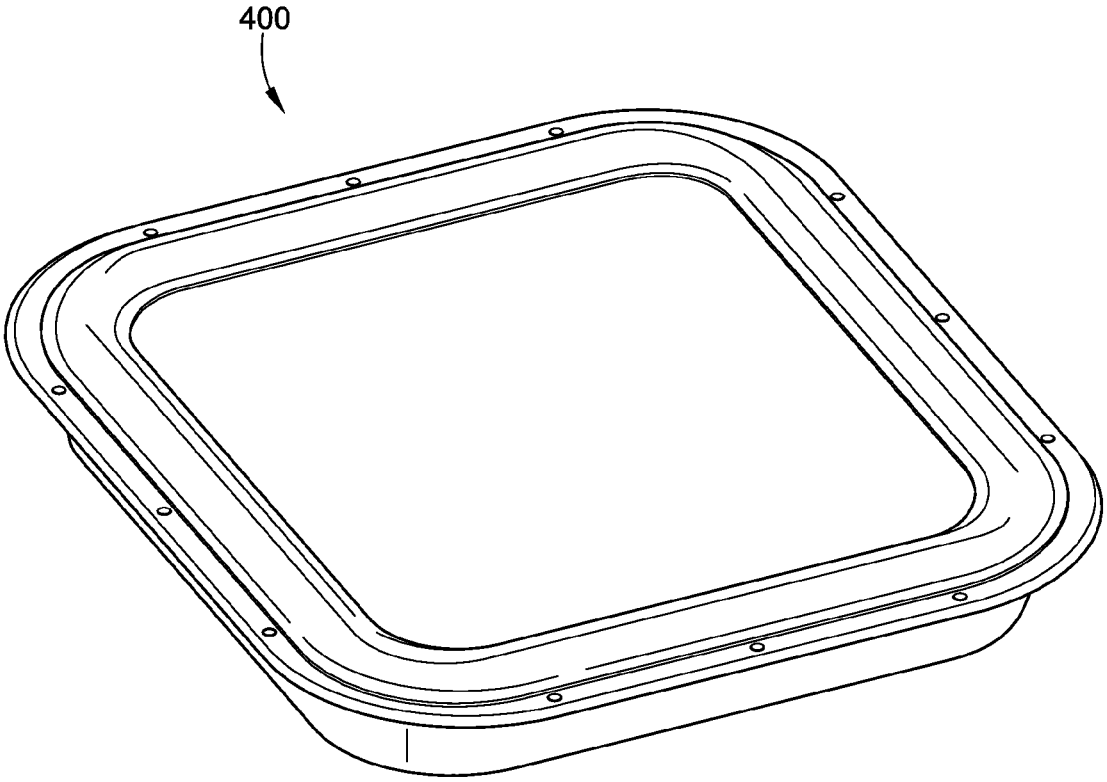
FIGS. 7 and 8 are perspective views of a rectangular low-profile speaker, constructed in accordance with an embodiment of the invention.
Figure 8:
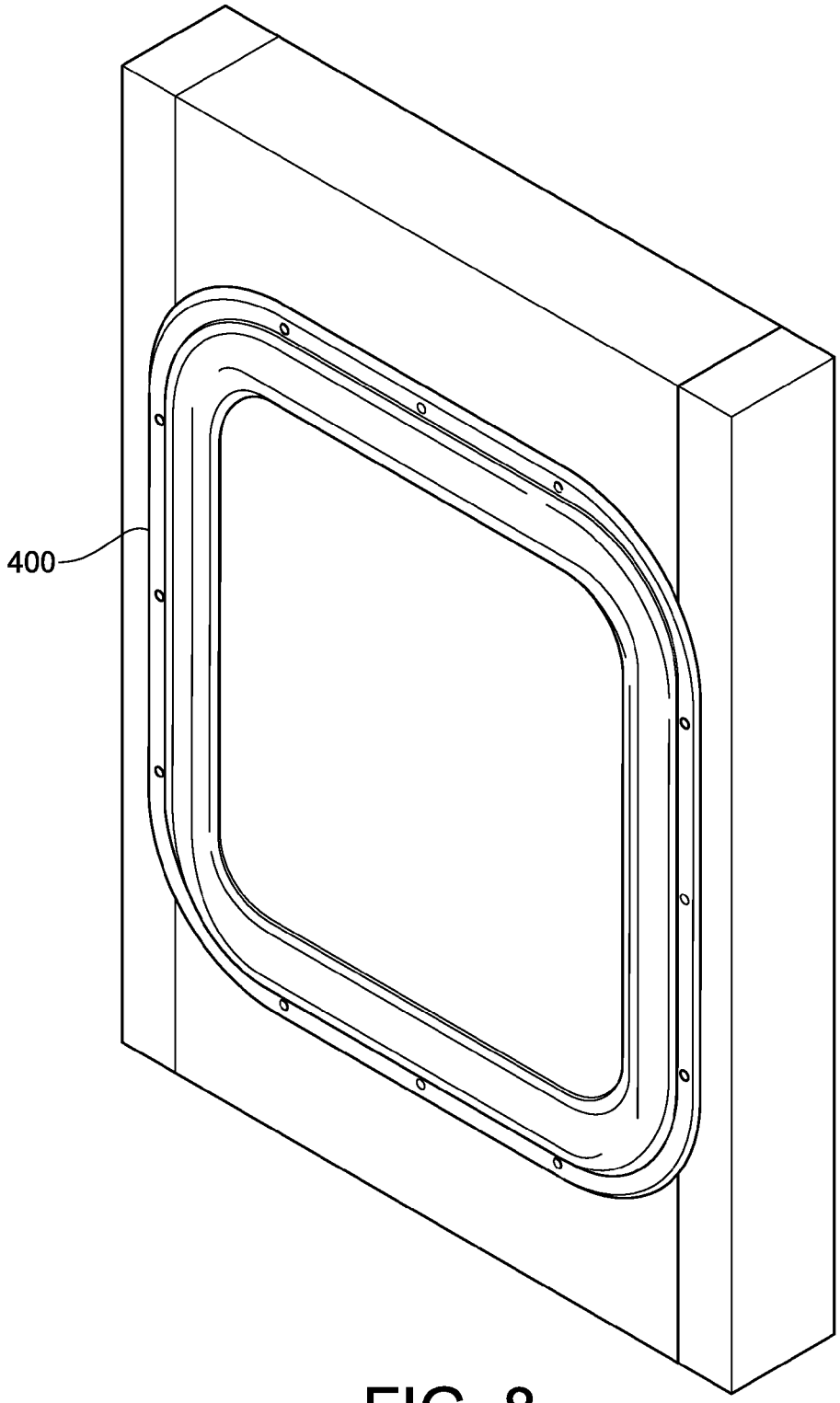
Figure 9:
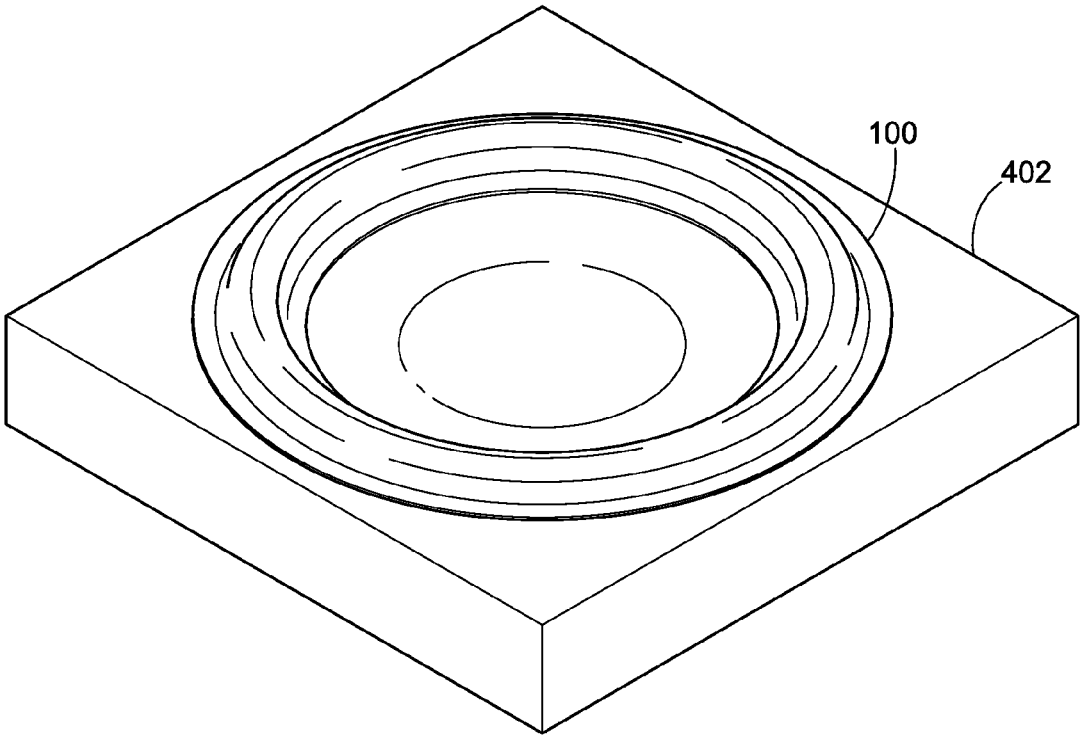
FIG. 9 is a perspective view of the low-profile speaker of FIG. 1 assembled in a square housing.

FIGS. 7 and 8 show perspective views of a rectangular low-profile speaker 400, constructed in accordance with an embodiment of the invention. The components and inner working of the rectangular speaker 400 are similar or identical to those in the embodiment described above, except that the frame, surround, magnet assembly, voice coil, and support ring, and cone are rectangular rather than circular. Of course, in alternate embodiments of the invention, the low-profile speaker can be constructed in other shapes such as oval, hexagonal, octagonal, triangular, or in any of a variety of shapes. One advantage of the rectangular speaker 400 shown in FIG. 7 is that is can be easily installed in a wall of a home or building fitting in between adjacent studs, as shown in FIG. 8. However, this can also be accomplished using the round low-profile speaker 100 installed in a rectangular box 402, as illustrated in FIG. 9.

Figure 10:
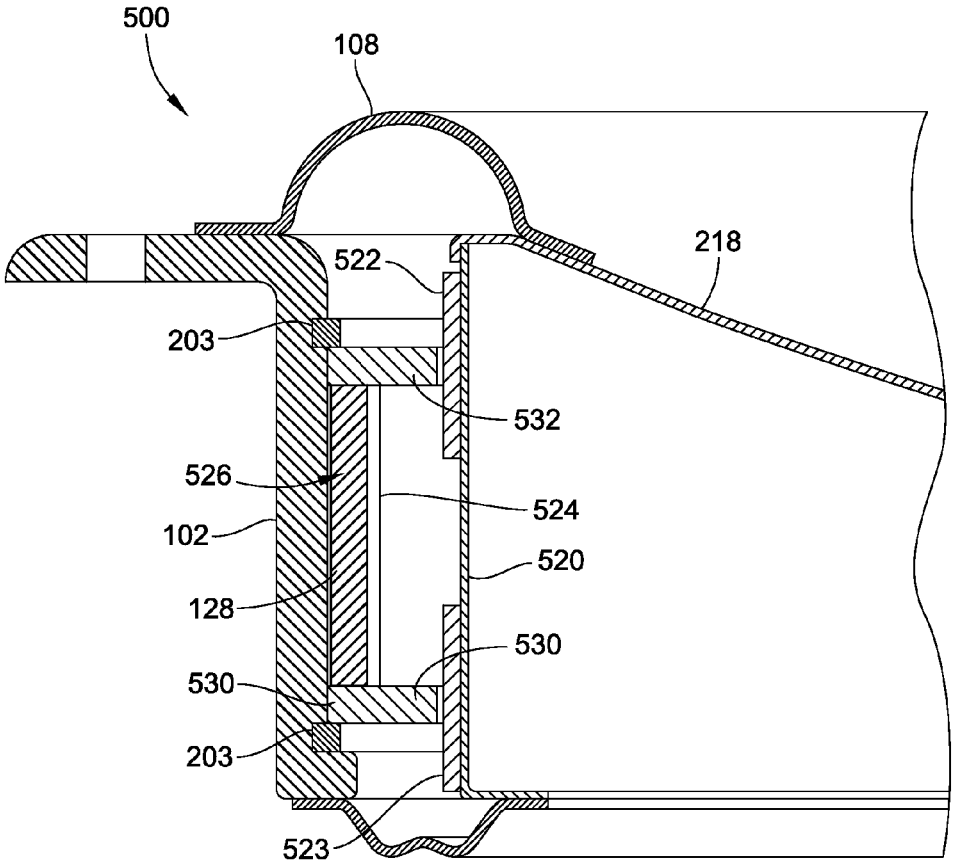
FIG. 10 is a cross-sectional view of a low-profile speaker, constructed in accordance with an alternate embodiment of the invention.

FIG. 10 is a plan view of a low-profile speaker 500 having a dual-coil configuration, in accordance with an embodiment of the invention. In this embodiment, the magnet assembly includes an annular cage 524 configured to hold either a plurality of relatively small magnets 128 in a magnet assembly 526, or a solid ring of composite magnetic material in a magnet assembly 526 such as described above. In a particular embodiment, the magnet assembly 526 is in contact, or in close proximity to the frame 102. A top plate 532 and bottom plate 530 of approximately equal size are attached, respectively, to the top edge and bottom edge of the magnet 128.

The top and bottom plates 532, 530 are made from a ferromagnetic material and project radially inward from the magnet 128 and perimeter of the frame 102. A first voice coil 522 is situated in relatively close proximity to the top plate 532, while a second voice coil 523 is situated in relatively close proximity to the bottom plate 530. In at least one embodiment, the two voice coils 522, 523 are wound in opposite directions around the support ring 520. In an alternate embodiment, the two voice coils 522, 523 are wound in the same direction, but the terminal ends of the first voice coil 522 are connected to a power supply (not shown) such that the polarities are the reverse of the terminal ends of the second voice coil 523. In this fashion, the voice coils 522, 523, which are located in proximity to opposite poles of the magnets 128, move in the same direction in response to the electrical signals that drive the speaker 500.

Figure 11:
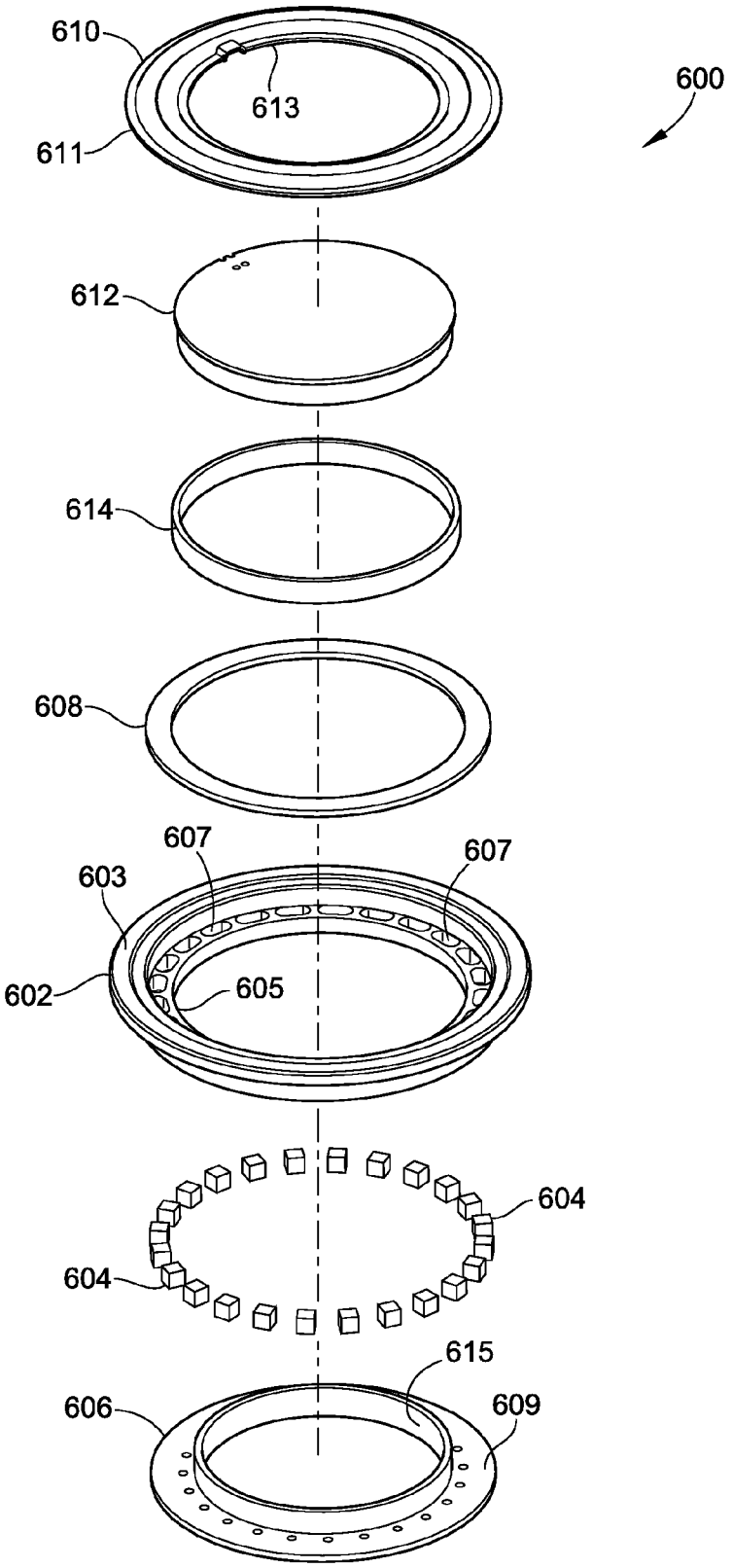
FIG. 11 is an exploded isometric view of a low-profile speaker, constructed in accordance with an embodiment of the invention.

FIG. 11 is an exploded isometric view of a low-profile speaker 600, constructed in accordance with an embodiment of the invention. Low-profile speaker 600 has an annular stepped frame 602 with a flange 603 and an interior step 605. Around the circumference of the interior step 605, there are a plurality of rectangular openings 607 to hold a plurality of magnets 604. Though held in place by the rectangular openings 607, each of the plurality of magnets 604 is supported on the bottom by a pole piece 606 and supported on the top by a top plate 608. The pole piece 606 includes an annular horizontal portion 609, and an annular vertical portion 615. In the embodiment shown, the magnets 604 are cube-shaped, though, in alternate embodiments, the magnets may have shapes other than cubed, and the rectangular openings 607 may be other than rectangular. In a further embodiment, the plurality of magnets 604 may be replaced by a solid ring of composite magnetic material, as described above.

The pole piece 606 and top plate 608 are made from a ferromagnetic material. An annular surround 610 made from a resilient material, such as butyl rubber, has an outer perimeter portion 611 and an inner perimeter portion 613. The outer perimeter portion 611 is attached to the flange 603 of the annular stepped frame 602, while the inner perimeter portion 613 is attached to a cone disc 612, which integrates the cone and support ring of the previous embodiments. In a particular embodiment, the cone disc 612 is made from aluminum, which has the effect of reducing magnetic eddy currents during speaker operation. As a result, the low-profile speaker 600 operates more efficiently, i.e., requiring less power for the equivalent output when compared to the low-profile speaker 600 using a non-metallic cone disc 612. In an alternate embodiment, the cone disc 612 is made from a transparent material allowing for a clear view of the interior components of the speaker. In this case lights could be placed behind the transparent surface of the cone disc to enhance the appearance of the low-profile speaker 600. Further, the transparent material could be coated to allow for digital photographs or video to be shown on the surface of the cone disc 612.

A voice coil 614 is wound around a perimeter portion 619 of the cone disc 612. One of skill in the art will recognize that the voice coil 614 could be integrated with the cone disc such that a single component could include the cone, support ring and voice coil shown in the embodiment of FIG. 2, for example.

Low-profile speaker 600 operates much like the embodiments described above. When fully assembled, there is a gap (not shown) between the top plate 608 and the vertical portion 615 of the pole piece 606. The voice coil 614 and the perimeter portion 619 of the cone disc 612 are suspended in the gap, held in place by the surround 610. As can be seen from FIG. 11, the surround 610 has two arched portions rather than the one arched portion shown in the surround 108 of FIG. 2. With the larger surround 610 of FIG. 11, there is a more substantial attachment between the surround 610 and the cone disc 612. This provides greater support and stability to the cone disc 612 and voice coil 614.

Figure 12:
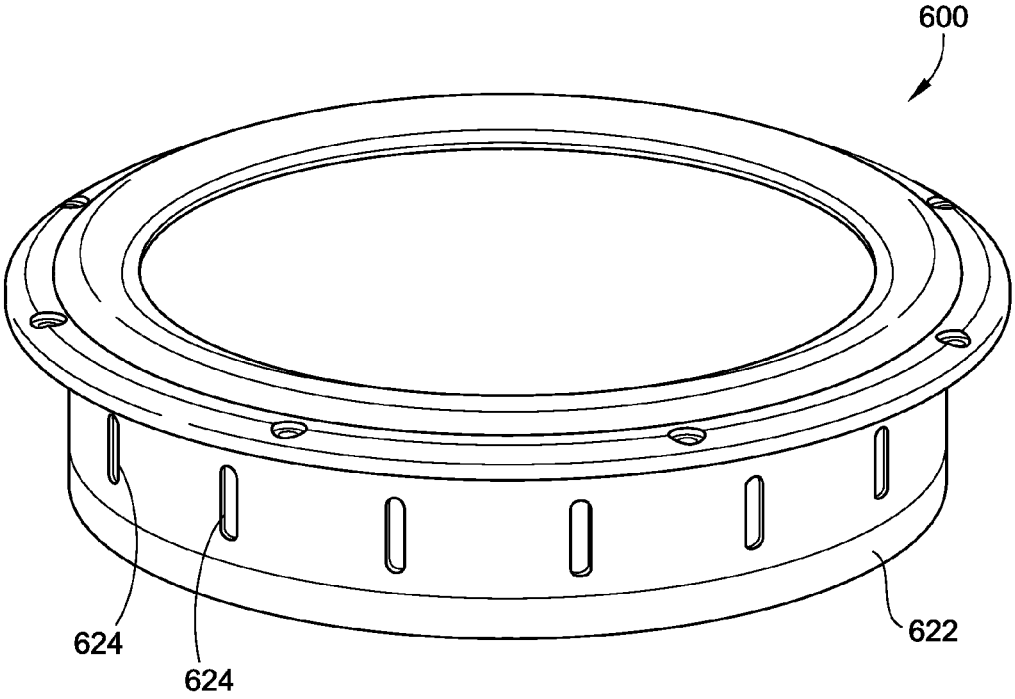
FIG. 12 is an isometric view of the low-profile speaker of claim 11, including a frame with a plurality of openings.

FIG. 12 shows an isometric view of low-profile speaker 600 assembled. In the embodiment of FIG. 12, low-profile speaker 600 includes a frame 622 with a plurality of slots 624 in a perimeter portion of the frame 622. In the embodiment shown, the slots are vertically oriented. The slots permit a cooling flow of air into and out of the low-profile speaker 600. In alternate embodiments, the slots 624 could be round holes, or otherwise suitably shaped openings to allow a flow of air through the speaker 600. In a further embodiment, the pole piece 606 may have a plurality of openings similar or identical to those in the frame 622. In addition to the cooling function, the plurality of slots 624 also reduces the back pressure inside the low-profile speaker 600 caused by movement of the cone disc 612 during speaker operation. This reduces the stress on slow-profile speaker 600 components. In conventional sealed speakers, it is common for back pressure to increase during speaker operation. While the embodiment of FIG. 12 shows that the low-profile speaker 600 and most components are round, other shapes, including, but not limited to, rectangular, hexagonal, octagonal, oval, and triangular are envisioned within the scope of the invention.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A low-profile speaker comprising: a low-profile frame; at least one magnet disposed in an enclosure in the low-profile frame, said enclosure configured to provide a gap which leads into the enclosure; a support assembly comprising a cone having a central axis and an outer perimeter; a support ring attached to the cone, proximate the outer perimeter of the cone; a voice coil wound onto the support ring, wherein the support ring and voice coil extend through the gap into the enclosure, and are suspended in proximity to the at least one magnet disclosed in the enclosure, wherein the support ring and voice coil oscillate in response to electrical signals in the voice coil; and a surround attached to the low-profile frame and attached to the cone, wherein the surround is attached to the cone at a point which is closer to the central axis of the cone than is a point at which the support ring is attached to the cone and the surround is attached to the frame at a point which is further from the central axis of the cone than is the point at which the support ring is attached to the cone, wherein the support ring is configured and positioned such that the voice coil is aligned with the at least one magnet in a plane which is perpendicular to a central axis of the low-profile speaker.

2. The low-profile speaker of claim 1, wherein the enclosure comprises a bottom plate, wherein said voice coil is disposed between the surround and the bottom plate of the enclosure.

3. The low-profile speaker of claim 1, wherein the at least one magnet contacts the low-profile frame.

4. The low-profile speaker of claim 1, wherein the enclosure comprises a top plate in contact with the low-profile frame, a bottom plate in contact with the low-profile frame, and wherein said at least one magnet is disposed between the top plate and the bottom plate.

5. The low-profile speaker of claim 4, wherein the bottom plate comprises a pole piece, said gap being provided between the top plate and the pole piece.

6. The low-profile speaker of claim 4, wherein the enclosure further comprises a second top plate, said gap being provided between the top plate and the second top plate.

7. The low-profile speaker of claim 1, wherein the at least one magnet comprises a plurality of magnets.

8. The low-profile speaker of claim 1, wherein the at least one magnet comprises at least one solid ring of composite magnetic material.

9. The low-profile speaker of claim 1, further comprising at least one magnet assembly comprising a cage, wherein the at least one magnet is disposed in the cage within the enclosure.

10. The low-profile speaker of claim 1, wherein the low-profile frame comprises at least one pocket in which the at least one magnet is disposed.

11. The low-profile speaker of claim 1, wherein the low-profile frame comprises a plurality of pockets, wherein the at least one magnet comprises a plurality of magnets, wherein the plurality of magnets are disposed in the pockets in the low-profile frame.

12. The low-profile speaker of claim 1, wherein the surround comprises an outer perimeter portion, an inner perimeter portion, and an arched portion which joins the inner and outer perimeter portions.

13. The low-profile speaker of claim 1, wherein the outer perimeter portion is attached to the low-profile frame, and the inner perimeter portion is attached to the cone.

14. The low-profile speaker of claim 1, wherein the surround comprises a resilient material.

15. The low-profile speaker of claim 1, wherein the surround comprises butyl rubber.

16. The low-profile speaker of claim 1, wherein the interior step defines a plurality of pockets spaced apart from each other, wherein said at least one magnet comprises a plurality of magnets comprising one magnet in each of said pockets, and wherein the magnets are spaced apart relative to each other.

17. A low-profile speaker comprising: a low-profile frame; at least one magnet disposed in an enclosure in the low-profile frame, said enclosure configured to provide a gap which leads into the enclosure; a support assembly comprising a cone having a central axis and an outer perimeter; a support ring attached to the cone, proximate the outer perimeter of the cone; a voice coil wound onto the support ring, wherein the support ring and voice coil extend through the gap into the enclosure, and are suspended in proximity to the at least one magnet disclosed in the enclosure, wherein the support ring and voice coil oscillate in response to electrical signals in the voice coil; and a surround attached to the low-profile frame and attached to the cone, wherein the surround is attached to the cone at a point which is closer to the central axis of the cone than is a point at which the support ring is attached to the cone and the surround is attached to the frame at a point which is further from the central axis of the cone than is the point at which the support ring is attached to the cone, wherein the low-profile frame defines a plurality of spaced apart pockets, wherein said at least one magnet comprises a plurality of magnets disposed in said pockets, wherein the support ring is configured and positioned such that the voice coil is aligned with the plurality of magnets in a plane which is perpendicular to a central axis of the low-profile speaker.

18. A low-profile speaker comprising: a low-profile frame; at least one magnet disposed in an enclosure in the low-profile frame, said enclosure configured to provide a gap which leads into the enclosure; a support assembly comprising a cone having a central axis and an outer perimeter; a support ring attached to the cone, proximate the outer perimeter of the cone; a voice coil wound onto the support ring, wherein the support ring and voice coil extend through the gap into the enclosure, and are suspended in proximity to the at least one magnet disclosed in the enclosure, wherein the support ring and voice coil oscillate in response to electrical signals in the voice coil; and a surround attached to the low-profile frame and attached to the cone, wherein the surround is attached to the cone at a point which is closer to the central axis of the cone than is a point at which the support ring is attached to the cone and the surround is attached to the frame at a point which is further from the central axis of the cone than is the point at which the support ring is attached to the cone, wherein the at least one magnet comprises a plurality of magnets; spaced apart from each other, and disposed in pockets defined by the low-profile frame, wherein the support ring is configured and positioned such that the voice coil is aligned with the plurality of magnets in a plane which is perpendicular to a central axis of the low-profile speaker.

* * * * *